US005228879A

United States Patent [19]

Fromm

[11] Patent Number: 5,228,879

[45] Date of Patent: Jul. 20, 1993

[54] TOY MIRROR ASSEMBLY

[76] Inventor: Wayne G. Fromm, 4 Glenarden Crescent, Richmond Hill, Ontario, Canada, L4B 2G2

[21] Appl. No.: 932,327

[22] Filed: Aug. 19, 1992

Related U.S. Application Data

[63] Continuation-in-part of Ser. No. 824,842, Jan. 24, 1992, abandoned.

[51] Int. Cl.[5] ..... A63H 33/22; A63H 33/30; A63H 33/26

[52] U.S. Cl. ..... 446/219; 446/472; 446/485; 40/219; 40/442; 40/455; 40/900; 472/58; 362/140; 362/806

[58] Field of Search ..... 446/219, 472, 485, 479, 446/482; 40/219, 442, 443, 444, 455, 538, 540, 573, 900; 472/58, 63; 263/161; 362/135, 140, 806, 808

[56] References Cited

U.S. PATENT DOCUMENTS

| | | | |
|---|---|---|---|
| 647,139 | 4/1900 | Howe . | |
| 856,497 | 6/1907 | Southam et al. . | |
| 1,057,820 | 4/1913 | Gernsback . | |
| 1,197,736 | 9/1916 | Hartford et al. . | |
| 1,768,409 | 6/1930 | Kuczorra | 40/219 |
| 2,221,888 | 11/1940 | White . | |
| 2,221,889 | 11/1940 | White . | |
| 2,483,901 | 10/1949 | Harris . | |
| 3,655,532 | 4/1972 | Toppel . | |
| 3,745,678 | 7/1973 | Thomassen | 40/219 X |
| 3,798,833 | 3/1974 | Campbell . | |
| 3,805,432 | 4/1974 | Davis et al. . | |
| 4,072,314 | 2/1978 | Rosen . | |
| 4,180,931 | 1/1980 | Osch | 472/58 X |
| 4,273,418 | 6/1981 | Gillespie et al. . | |
| 4,365,798 | 12/1982 | Shields et al. . | |
| 4,737,131 | 4/1988 | Sirota | 446/485 X |
| 4,882,565 | 11/1989 | Gallmeyer | 362/83.1 X |
| 4,922,384 | 5/1990 | Torrence | 40/219 X |
| 5,084,803 | 1/1992 | Lan | 446/485 X |
| 5,118,319 | 6/1992 | Smith et al. | 446/219 |

OTHER PUBLICATIONS

"Laughing Mirror" Gemney Industries Corp., Irvine, Tex. 75038.

*Primary Examiner*—Robert A. Hafer
*Assistant Examiner*—D. Neal Muir
*Attorney, Agent, or Firm*—John C. Thompson

[57] ABSTRACT

A hand held two-way mirror assembly 10 having one or more hidden images 26 mounted behind the back surface of a two-way mirror 20, one of which images can be seen when a light 36 behind the image is lit. The mirror assembly includes a frame 12, 14, 16, there being a cavity 30 behind the mirror 20, which cavity receives the lights 36 and a circuit board 48. A speaker 50 is mounted on the board. One or more digitized voices is stored in a memory chip 54 mounted on the board. Electronic switches 52 and 56 select a lamp 36 to be lit when a manually engageable switch is operated, and also cause one of the digitized voice tracks to be broadcast through the speaker, the particular voice track being associated with the illuminated image, the lights and voices preferably being selected in a predetermined manner to follow a script.

19 Claims, 2 Drawing Sheets

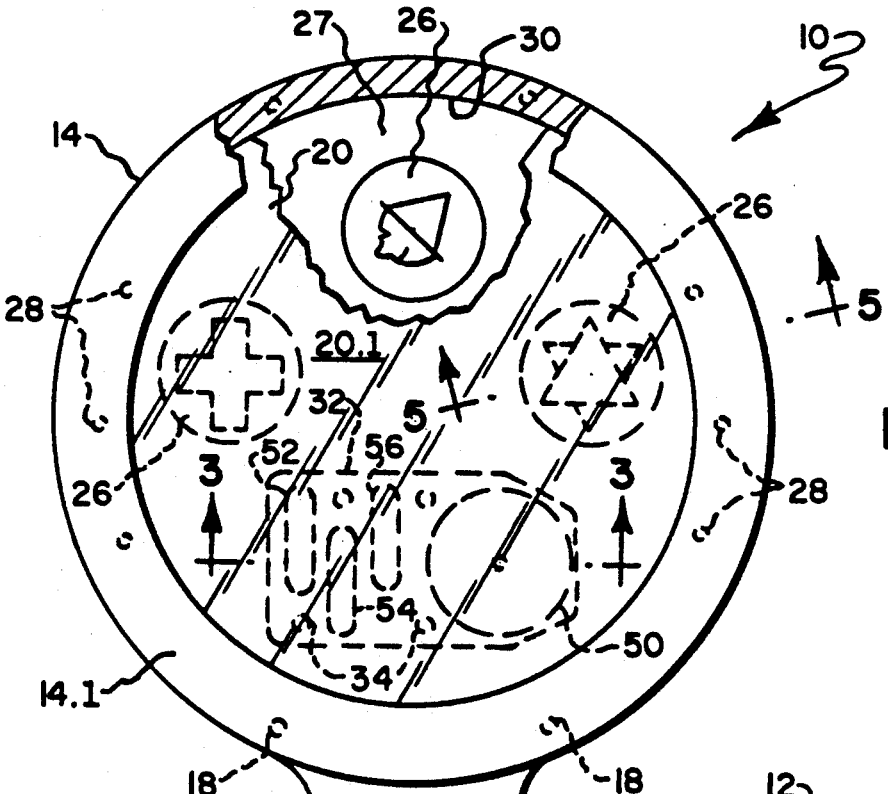
Fig. 1.
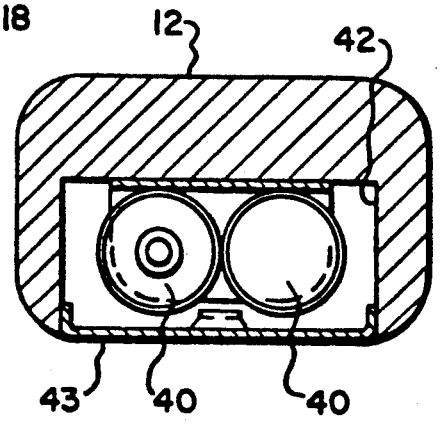
Fig. 4.
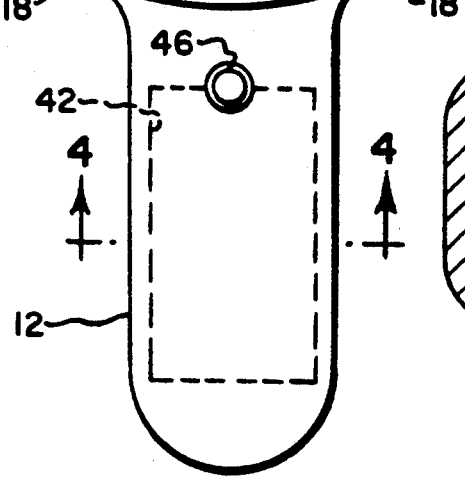
Fig. 3.
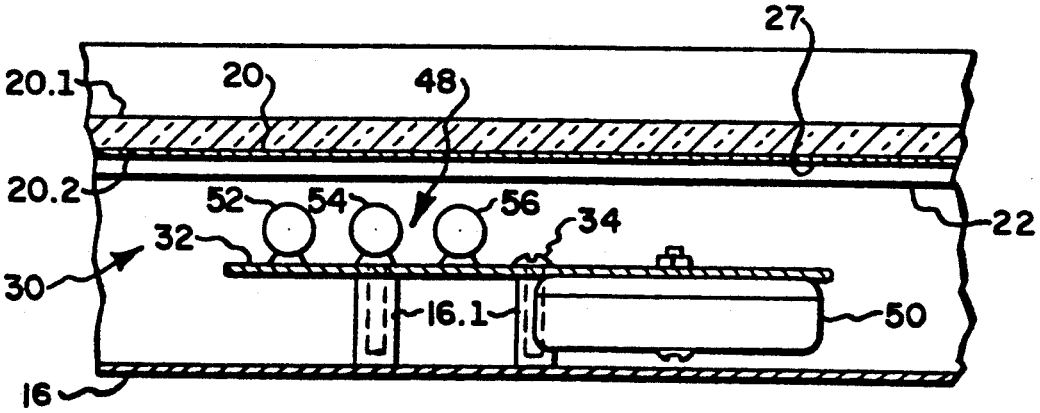

TOY MIRROR ASSEMBLY

CROSS REFERENCE TO RELATED PATENT APPLICATIONS

The present invention is a continuation-in-part application of U.S. patent application Ser. No. 07/824,842 filed Jan. 24, 1992 by Wayne G. Fromm and bearing the same title, the foregoing application having been abandoned after this application was filed.

TECHNICAL FIELD

The present invention relates generally to toy mirror assemblies, and more particular to one having one or more hidden images mounted behind a two-way mirror and which can be seen when a light behind an image is lit, the device also having one or more digitized voice tracks which can be associated with the illuminated hidden images, the voice tracks also being heard while an image is illuminated.

BACKGROUND OF THE INVENTION

Toy devices embodying two-way mirrors are well known in the prior art where the mirror is mounted in a structure provided with a figure or representation in a cavity behind the mirror, which figure or representation may be illuminated. One such an example is shown in U.S. Pat. No. 4,072,314 to Rosen. The purpose of the Rosen device is to provided a toy where children may see a normally hidden image when the toy is turned on, and which toy may be provided with a plurality or voice tracks one of which is randomly selected by a mechanism within the toy when the toy is turned on. In Rosen a three dimensional figure is disposed behind a two-way mirror, which figure may be illuminated through operation of a suitable switch. The mirror is pivotally mounted on a base. Rosen further discloses a multi-track disk player in the base which commences operation simultaneously with the operation of the light behind the mirror, the disc player randomly playing one of the disc tracks on the disc.

A somewhat similar concept is shown in U.S. Pat. No. 3,798,833 to Campbell which discloses a crystal ball-like object having an image provided therein, which image may be illuminated and seen when the device is turned on, the device also being provided with a multi-track disc player, one of which tracks is played when the toy is turned on.

Another patent which discloses a device behind a mirror is U.S. Pat. No. 2,483,901 to Harris which discloses an advertising device having two separated compartments, each of which may receive a product to be advertised. Each compartment can be individually illuminated to display the product therein. Davis et al U.S. Pat. No. 3,805,432 discloses a display device provided with a continuous belt carrying advertising messages, the belt being disposed behind a two-way mirror. A speaker is also associated with this device.

Other two-way mirror devices are U.S. Pat. Nos. 1,197,736 and 647,139 to Hartford et al and Howe, respectively. In Hartford a view behind the mirror is illuminated when a coin is placed in a receptacle. In Howe an image mounted behind the mirror may be seen when the mirror is held up to the light.

OBJECTS AND SUMMARY OF THE INVENTION

It is an object of the present invention to provide a toy mirror assembly having a two-way mirror which carries a plurality of spaced apart transparencies or transparent or images, a plurality of light sources mounted behind the images, each light source being associated with only a single transparent image, and electronic means for causing a single light source to be selected to illuminate only one of the transparent images when a manually operated switch is engaged to initiate the operation of the two-way mirror assembly.

It is a further o of the present invention to provide a hand held toy mirror assembly wherein the frame which supports a two-way mirror is provided with a handle so that a child can hold the mirror, the two-way mirror concealing a hidden image and being capable of illuminating the image and playing a voice associated with that image when a manually operated switch is engaged.

It is a still further object of the present invention to provide a toy mirror assembly for displaying one of a plurality of hidden images and for playing a voice associated with that image, the assembly including electronic circuit means including switching means which initiates operation of a light source which is capable of illuminating one single hidden image, another switching means initiating the operation of selected voice track shortly after the selected light source is energized, the selected voice being associated with the illuminated view.

It is another object of the present invention to provide a toy mirror assembly of the type set forth above wherein the electronic circuit means, is programmed to operate the lights and the voice tracks in a predetermined sequence to follow a selected story line.

In summary the foregoing objects are accomplished by providing a mirror assembly having a two-way mirror which has a plurality of transparent images mounted on or adjacent the back side of the mirror, a cavity behind the mirror containing light sources, each light source being associated with a single transparent image, the assembly also including a speaker and electronic devices. The electronic devices include a circuit which is used to initiate the operation of one of the light sources when a manually engageable switch is closed, the circuit also causing a voice track to be played through the speaker, the voice track being one of a plurality of digitized voice tracks which are stored in memory, the particular voice track being associated with the illuminated image, the lights and voice tracks preferably being selected in a predetermined manner to follow a script.

The foregoing will become more apparent after a consideration of the following detailed description taken in conjunction with the accompanying drawings in which the principles of the foregoing invention are illustrated.

BRIEF DESCRIPTION OF THE FIGURES

FIG. 1 is a front view of the mirror assembly of this invention.

FIG. 3 is a sectional view taken generally along the line 3—3 in FIG. 1.

FIG. 4 is a sectional view taken generally along the line 4—4 in FIG. 1.

DETAILED DESCRIPTION

Figure 2:
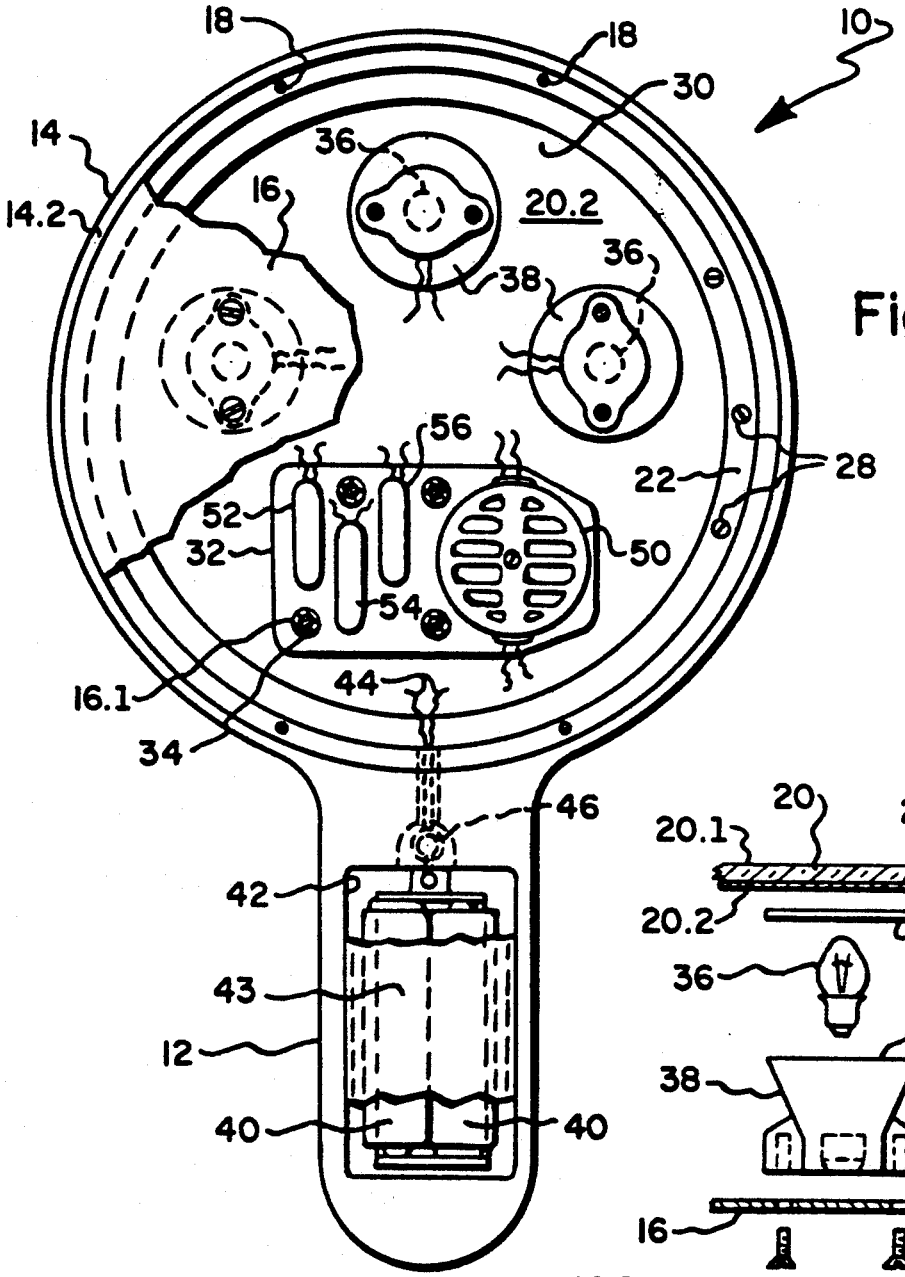
FIG. 2 is a back view of the mirror assembly shown in FIG. 1, this view being shown in partial section.
Figure 6:
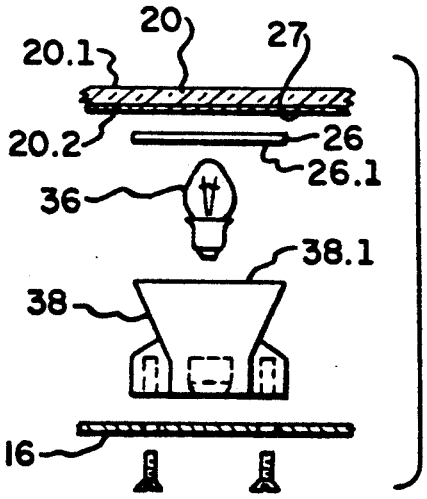
FIG. 6 is an exploded view of the reflector assembly shown in FIG. 5.
Figure 5:
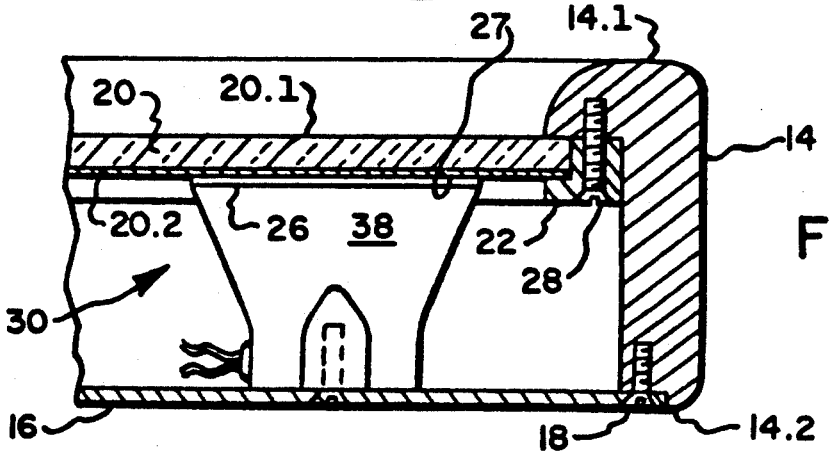
FIG. 5 is a sectional view taken generally along the line 5—5 in FIG. 1.

The hand held mirror assembly of this invention is indicated generally at 10, the assembly including a support which is capable of supporting the various components of the assembly. The support includes a handle 12, an annular frame 14 which is normally positioned above the handle when in use, and a removable back 16. The removable back 16 is secured to a back portion 14.2 of the annular frame 14 by screws 18 or other suitable fasteners. A two-way mirror 20 is secured to a front portion 14.1 of the annular frame. If the mirror is made from glass, a thin metal coating will be placed on the back side 20.2 of the glass, the coating being sufficiently thick so that it will reflect an image when viewed from the front surface 20.1 of the glass, but which will permit light to project through the coating when the light behind the glass or mirror 20 is brighter than the light in front of the mirror. This form of mirror is well known in the art as a two-way mirror. If the mirror 20 is made from glass it will be secured in place to the front portion 14.1 of the annular frame by a retainer ring 22 provided with a suitable lip, the retainer ring in turn being secured to the front portion 14.1 of the annular frame by screws 24 or other suitable fasteners. While for convenience of illustration the mirror has been shown as a glass mirror, it is envisioned that in the commercial application of this invention, the mirror will be made from a plastic film provided with a thin metal coating on the back surface of the film.

According to the principles of this invention transparent images 26 are supported on or immediately adjacent the back side 20.2 of the mirror 20. In the preferred embodiment, the transparent images are printed on translucent paper 27 which is disposed next to the mirrored surface. Alternatively, the transparent images may be formed from film or they may be suitably printed on the back of the mirror. In a commercial embodiment, where the mirror is designed to represent the hand mirror shown in the movie "Beauty and The Beast", the images will be of various movie characters. Thus, while only a single image may be associated with the mirror, in the preferred embodiment a plurality of transparent images will be utilized. In addition, the front surface of the frame 14 may also be provided with lights 28 which may be flashed on and off. In operation of the initial commercial version of this invention, the lights 28 will be flashed on and off only at the commencement of the operation of the mirror apparatus, and will not be flashed on and off after the images are lighted.

As can be seen there is a cavity 30 behind the mirror 20, the cavity 30 being defined by the back side of the media (27) on which the images are printed the annular frame 14, and the removable back 16. Various components of the mirror assembly are mounted within the cavity. Thus, a circuit board 32 may be mounted within the cavity 30. To this end the removable back is provided with integral bosses 16.1, the board 32 being secured thereto by screws 34. A plurality of electronic components are mounted on the board 32, which components will be described below.

A light source is provided for each transparent image. To this end, a light bulb or lamp 36 is mounted behind each image, the lamp being disposed in a shield in the form of a reflective housing or reflector 38. The lamps 36 and reflectors 38 are so designed that the light intensity on the associated images will be substantially uniform. The reflector 38 can be mounted upon the removable back, or it can be formed integrally with it. There is one reflective housing 38 for each image 26, however, the reflective housings may in fact be formed in a one piece mold made of reflective material having one or more housings - similar to a reflective lens of an automobile tail light assembly. Each reflective housing is so designed that its peripheral edge 38.1 will contact the peripheral edge 26.1 of the image 26 in light sealing relationship. As can be seen, when the bulb or lamp 36 is illuminated, the light from the lamp will be reflected by the reflective housing 38 to cause the transparent image 26 to be visible from the front side 20.1 of the mirror 20.

In order to power the flashing lights 28, a selected lamp 36, and the other electronic components, one or more batteries 40 are mounted within a battery compartment 42, two batteries being illustrated. While the battery compartment may be in the handle 12 of the support as shown, in the commercial embodiment the battery compartment is located in the cavity 30. The battery compartment 40 may be closed by a suitable cover 43. A suitable lead 44 extends from the battery compartment to the circuit board 32 to carry current from the batteries to the circuit board. A manually operated normally open switch 46 is provided on the handle 12. Current flow will be initiated when the switch is closed. The parts may be so arranged and designed that when the switch is momentarily closed a relay (not shown) on the board will be closed, until a timer (also not shown) times out to cause the relay to resume its normally open state.

The various electronic devices carried on the circuit board 28 are indicated generally at 48. One such device is a speaker 50. Other devices include a first switching means 52 for initiating the operation of one or more light sources 36 in response to closing the manually operated switch 46, the operation of each light source being for a limited length of time. One or more memory devices 54 are also carried by the circuit board, the memory devices having stored therein a plurality of digitized voices or voice tracks. Further switching means 56 are also provided, which switching means initiates the retrieval and broadcast of a selected one of the stored voices shortly after the light source is energized to illuminate a view, each selected voice being associated with a particular image. The actual details of the various electrical components and the wiring between the circuit board and the lights 28 and lamps 36 is not shown, as such should be apparent to those having ordinary skill in the art from the following description of the operation. While a relay, a timer, and switching means have been set forth above, the function of these devices can be programmed into a programmable integrated circuit.

In the operation of the initial commercial embodiment which shows various characters for the Disney movie Beauty and the Beast, a child will pick up the hand mirror and look at their reflection in the mirror. The child will initiate operation of the mirror assembly by pressing the switch 46. The switch 46, once depressed, triggers sequential character images from Disney's Beauty and the Beast to magically appear along with the child's reflected image in the mirror. Each character appears momentarily with it's character voice inviting the child to join Belle in saying "SHOW ME THE BEAST", after which the Beast appears and says to Belle, "I LOVE YOU".

Upon initial activation lights 28 inside the perimeter of the mirror accompanied by "dream-like" music. The flashing lights are followed by the image of the characters LUMIERE, COGSWORTH, MRS. POTTS, CHIP, BELLE and BEAST, illuminating inside the mirror accompanied by the following script recorded by the original film stars for this mirror: SCRIPT:

(1) LUMIERE: "WE INVITE YOU TO BE OUR GUEST"
(2) COGSWORTH: "YOU LOOK SPLENDID TODAY"
(3) MRS. POTTS: "LOVELY, NOW LOOK IN THE MIRROR"
(4) CHIP: "YEA! JUST SAY"
(5) BELLE: "SHOW ME THE BEAST"
(6) BEAST: "I LOVE YOU"

(In the initial commercial embodiment both character images 3 and 4 appear in one scene. Same scene lights up for voices 3 and 4. Thus there are a total of five lighted scenes, four being round and one being heart shaped.)

Each time the start button is pushed the order of speech and accompanying image changes to include:

(1) Voices 1, 2, 3, 4, 5 and 6;
(2) Voices 3, 4, 5 and 6;
(3) Voices 1 and 2; and
(4) Voices 5 and 6.

While a preferred form of the present invention has been shown and described above, it is to be understood that this invention is not to be limited to the particular details shown and described above, but that, in fact, widely differing means may be employed in practice on the broader aspects of this invention.

What is claimed is:

1. A hand held two-way mirror assembly for displaying a selected one of a plurality of hidden images when operated; said mirror assembly comprising:

a support including an annular frame having front and back portions;

a two-way mirror of the type having a viewing side and a back side, the two-way mirror normally reflecting the image of the viewer, but which mirror will permit the viewer to see through the mirror when light behind the mirror is brighter than light in front of it, the mirror being supported by the front portion of the annular frame, there being a cavity behind the mirror which is defined by the back of the mirror, the annular frame, and the back portion;

a plurality of spaced apart transparent images behind the back side of the mirror when the mirror is supported by the front portion of the annular frame, each transparent image having a peripheral edge;

a plurality of light sources mounted within the cavity, one source being associated with each transparent image, each light source including a lamp and a shield which insures that light from the associated lamp will only illuminate one transparent image;

a battery compartment carried by the support for holding one or more batteries;

electronic circuit means carried by the support, the circuit means including switching means for initiating operation of a single light source at a time for a limited length of time in response to operation of the electronic circuit means; and a manually operated switch carried by the support and capable of initiating operation of the electronic circuit means when engaged.

2. The hand held two-way mirror assembly as set forth in claim 1 wherein the shield is a reflector which has a peripheral edge which contacts the peripheral edge of the associated transparent image behind the back of the mirror.

3. The hand held two-way mirror assembly as set forth in claim 1 wherein the support includes a handle normally positioned below the annular frame, and wherein the manually operated switch is located on the handle.

4. The hand held two-way mirror assembly as set forth in claim 1 wherein a speaker is carried by the mirror assembly, wherein the electronic circuit means includes memory assemblies provided with digitized electronic voice tracks, and wherein the switching means is capable of initiating the retrieval and broadcast through the speaker of one of the voice tracks shortly after the operation of the single light source is initiated.

5. The hand held two-way mirror assembly as set forth in claim 4 wherein the electronic means is programmed to operate the lights and the voice tracks in a predetermined sequence to follow a selected story line.

6. A two-way mirror assembly for displaying one of a plurality of hidden images and for playing a voice track associated with that image, said mirror assembly comprising:

a support including an annular frame having front and back portions;

a two-way mirror of the type having a viewing side and a back side, the two-way mirror normally reflecting the image of the viewer, but which mirror will permit the viewer to see through the mirror when light behind the mirror is brighter that light in front of it, the mirror being supported by the front portion of the annular frame, there being a cavity behind the mirror which is defined by the back of the mirror, the annular frame, and the back portion;

a plurality of spaced apart transparent images behind the back side of the mirror;

a plurality of light sources supported by the back portion, one source being associated with each image, each light source including a lamp and a shield which insures that the light from the associated lamp will only illuminate one image;

a speaker carried by the support;

a battery compartment carried by the support for holding one or more batteries;

a manually operated switch carried by the support; and electronic circuit means carried by the support, the circuit means including a plurality of digitized voice tracks, each of which is operably interconnected with the speaker, and switching means for initiating operation of one light source at a time when the manually operated switch is initially manually operated, and for initiating the operation of a selected one of the voice tracks shortly after a light source is energized, the selected voice track being associated with the image that has been randomly illuminated.

7. The two-way mirror assembly as set forth in claim 6 wherein the support is hand held, the support including a handle normally positioned below the annular frame, the manually operated switch being located on the handle.

8. The two-way mirror assembly as set forth in claim 6 wherein the speaker and the electronic circuit means are mounted on a circuit board, the circuit board in turn being mounted within the cavity.

9. A hand held two-way mirror assembly for displaying one of a plurality of hidden images and for playing a voice associated with that image, said mirror assembly comprising:

a support including handle, an annular frame above the handle, the annular frame having front and back portions, and a removable back secured to the back portion of the annular frame;

a two-way mirror of the type having a viewing side and a back side, the two-way mirror normally reflecting the image of the viewer, but which mirror will permit the viewer to see through the mirror when light behind the mirror is brighter that light in front of it, the mirror being supported by the front portion of the annular frame, there being a cavity behind the mirror which is defined by the back of the mirror, the annular frame, and the removable back;

a plurality of spaced apart transparencies of cartoon characters or the like behind the back side of the mirror when the mirror is supported by the front portion of the annular frame;

a plurality of light sources disposed within the cavity and supported by the removable back, one source being associated with each transparency, each light source including a lamp and a reflector which insures that the light from the associated lamp will only illuminate one transparency;

a speaker mounted within the cavity;

a battery compartment carried by the support for holding one or more batteries;

a manually operated switch carried by the handle; and electronic circuit means carried by the support, the circuit means including a plurality of digitized voices, each of which is interconnected with the speaker, and switching means for initiating operation of one light source at a time when the manually operated switch is operated, and for initiating the operation of a selected one of the voices shortly after the light source is energized to illuminate a transparency.

10. The two-way mirror assembly as set forth in claim 9 wherein the switching means selects a particular voice which has previously been selected to be associated with the image that has been randomly selected, the electronic circuit means being programmed to operate the lights and the voices in a predetermined sequence to follow a selected story line.

11. A toy mirror assembly for displaying a hidden image when operated; said mirror assembly comprising:

a support including a frame;

a two-way mirror of the type having a viewing side and a back side, the two-way mirror normally reflecting the image of the viewer, but which mirror will permit the viewer to see through the mirror when light behind the mirror is brighter that light in front of it, the mirror being supported by the frame, there being a cavity behind the mirror when supported by the frame;

a speaker mounted within the cavity;

a battery compartment carried by the support for holding one or more batteries;

characterized by one or more transparent images supported on or adjacent a portion of the back side of the mirror when the mirror is supported by the frame;

one or more light sources mounted within the cavity behind the images, each light source being associated with only one transparent image, and each source being capable of illuminating the associated image to cause the associated image to be viewable when the light source is operated;

electronic circuit means carried by the support, the circuit means including one or more digitized voice tracks which are operably inter-connected with the speaker, and switching means initially initiating operation of a light source to illuminate the associated image, and initiating the operation of one digitized voice track when the light source is operated, the digitized voice track being associated essentially with the image being illuminated; and a manually operated switch carried by the support, the switch being normally open, but when closed completing a circuit between a battery and the electronic means to cause a light source to be operated and the associated digitized voice track to be broadcast by the speaker.

12. A toy mirror assembly as set forth in claim 11 wherein each light source includes a lamp and a shield which insures that the light from the lamp associated with the shield will only illuminate one transparent image.

13. The toy mirror assembly as set forth in claim 12 wherein the shield is a reflector which has a peripheral edge which contacts the peripheral edge of the associated transparent image behind the back of the mirror.

14. The toy mirror assembly as set forth in claim 11 wherein the frame includes an annular portion which supports the two-way mirror, wherein the support further includes a handle normally positioned below the annular frame, and wherein the manually operated switch is located on the handle.

15. The toy mirror assembly as set forth in claim 11 wherein the support includes a removable back secured to the back portion of the annular frame, the annular frame, removable back and the two-way mirror defining the cavity.

16. The toy mirror assembly as set forth in claim 11 wherein the speaker and the electronic circuit means are mounted on a circuit board, the circuit board in turn being mounted within the cavity.

17. The toy mirror assembly as set forth in claim 11 wherein the electronic circuit means includes memory assemblies provided with the digitized voice tracks, and wherein the switching means is capable of initiating the retrieval and broadcast through the speaker of one of the voice tracks shortly after the operation of the single light source is initiated.

18. The toy mirror assembly as set forth in claim 11 wherein a plurality of transparent images are supported on or adjacent a portion of the back side of the mirror, wherein there are a plurality of light sources, and wherein the electronic circuit means includes a plurality of digitized voice tracks, each of which is operably interconnected with the speaker, and wherein the switching means is capable of initiating operation of a single light source at a time when the normally open manually operated switch is initially closed, and for initiating the operation of a selected associated voice track shortly after a light source is energized.

19. The toy mirror assembly as set forth in claim 18 wherein the electronic means is programmed to operate the lamps and the digitized voice tracks in a predetermined sequence to follow a selected story line.

* * * * *